US009751322B2

(12) United States Patent
Mizusaki

(10) Patent No.: US 9,751,322 B2
(45) Date of Patent: Sep. 5, 2017

(54) FLUID TRANSPORT DEVICE

(71) Applicant: MIMAKI ENGINEERING CO., LTD., Nagano (JP)

(72) Inventor: Akihiko Mizusaki, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/311,508

(22) PCT Filed: May 14, 2015

(86) PCT No.: PCT/JP2015/063852

§ 371 (c)(1),
(2) Date: Nov. 15, 2016

(87) PCT Pub. No.: WO2015/174478

PCT Pub. Date: Nov. 19, 2015

(65) Prior Publication Data

US 2017/0106660 A1 Apr. 20, 2017

(30) Foreign Application Priority Data

May 16, 2014 (JP) ..... 2014-102903
Apr. 9, 2015 (JP) ..... 2015-080352

(51) Int. Cl.
*B41J 2/175* (2006.01)
*F04B 43/12* (2006.01)
(Continued)

(52) U.S. Cl.
CPC ..... *B41J 2/17596* (2013.01); *F04B 43/082* (2013.01); *F04B 43/086* (2013.01);
(Continued)

(58) Field of Classification Search
CPC ... B41J 2/17596; F04B 43/082; F04B 43/086; F04B 43/12; F04B 43/1223;
(Continued)

(56) References Cited

U.S. PATENT DOCUMENTS 6,641,249 B2 * 11/2003 Miyauchi ..... B41J 2/16523 347/30
7,011,387 B2 * 3/2006 Saito ..... B41J 2/16523 347/29
(Continued)

FOREIGN PATENT DOCUMENTS

| | | |
|---|---|---|
| JP | 2010000650 | 1/2010 |
| JP | 2011152647 | 8/2011 |
| JP | 4811013 | 11/2011 |

OTHER PUBLICATIONS

"International Search Report (Form PCT/ISA/210) of PCT/JP2015/063852", mailed on Jun. 23, 2015, with English translation thereof, pp. 1-2.

*Primary Examiner* — Anh T. N. Vo
(74) *Attorney, Agent, or Firm* — Jianq Chyun IP Office

(57) ABSTRACT

A waste ink recovery device (1) which is a fluid transport device has a tubing pump (40) configured to rotate around a shaft center by a motor, thereby transporting waste ink into a recovery container, flow passage members (30) for guiding the waste ink into the tubing pump (40), a flow passage selector (50), and a one-way clutch (70). The flow passage selector (50) has operating members (53) for opening and closing internal flow passages of the flow passage members (30), and an eccentric cam (54) configured to make the operating members (53) open and close the internal flow passages of the flow passage members (30).

6 Claims, 9 Drawing Sheets

(51) Int. Cl.
*F04B 43/08* (2006.01)
*F04B 45/047* (2006.01)
*F04B 45/053* (2006.01)

(52) U.S. Cl.
CPC ..... *F04B 43/12* (2013.01); *F04B 43/1223* (2013.01); *F04B 43/1238* (2013.01); *F04B 43/1253* (2013.01); *F04B 43/1276* (2013.01); *F04B 43/1292* (2013.01); *F04B 45/047* (2013.01); *F04B 45/053* (2013.01)

(58) Field of Classification Search
CPC ..... F04B 43/1238; F04B 43/1253; F04B 43/1276; F04B 43/1292; F04B 45/047; F04B 45/053
See application file for complete search history.

(56) References Cited

U.S. PATENT DOCUMENTS 7,014,291 B2 * 3/2006 Ishikawa ..... B41J 2/16511 347/29
7,854,600 B2 * 12/2010 Ogawa ..... F04B 43/082 417/474

* cited by examiner

| | FIRST CAM SURFACE | SECOND CAM SURFACE |
|---|---|---|
| 0° (ORIGIN) | OPEN | OPEN |
| 135° | OPEN | CLOSE |
| 225° | CLOSE | OPEN |

FLUID TRANSPORT DEVICE

CROSS-REFERENCE TO RELATED APPLICATION

This application is a 371 application of the international PCT application serial no. PCT/JP2015/063852, filed on May 14, 2015, which claims the priority benefit of Japan application no. 2014-102903,filed on May 16, 2014, and Japan application no. 2015-080352, filed on Apr. 9, 2015. The entirety of each of the above-mentioned patent applications is hereby incorporated by reference herein and made a part of this specification

TECHNICAL FIELD

The present invention relates to a fluid transport device.

BACKGROUND ART

There have been inkjet printers having cleaning mechanisms configured to seal nozzles of print heads with caps and generate negative pressures in the caps, thereby discharging thickened ink contained in the nozzles (see PTL 1 and PTL 2 for instance).

CITATION LIST

Patent Literature

PTL 1: Japanese Patent No. 4,811,013
PTL 2: JP-A-2011-152647

SUMMARY OF INVENTION

Technical Problem

The above-described cleaning mechanisms disclosed in PTL 1 and PTL 2 have waste ink recovery devices as fluid transport devices for transporting thickened ink (that is, waste ink) contained in the caps into recovery containers. The waste ink recovery devices needed a plurality of drive sources in order to open and close the insides of tube members provided corresponding to the caps, that is, the nozzles, or transport waste ink contained in the tube members into the recovery containers. For this reason, there was a tendency for the number of components to increase, resulting in an increase in cost and an increase in size.

The present invention was made in view of the above-described circumstances, and the present invention provides a fluid transport device capable of reducing the cost and the size.

Solution to Problem

In order to solve the above-described problems, a fluid transport device according to the present invention is a fluid transport device having one drive source, a pump configured to rotate around a shaft center by a driving force of the drive source, thereby transporting a fluid, and a plurality of flow passage members for transporting the fluid through the pump, wherein the pump includes a squeezing member configured to rotate around the shaft center, and a tube member constituting parts of the plurality of flow passage members, and the squeezing member includes a roller attached thereto so as to be movable between a squeezing position to which the roller is moved in a state where the roller has been advanced so as to be able to press the tube member, thereby squeezing the tube member, thereby transporting the fluid, and a release position to which the roller is moved in a state where the roller has been retracted so as not to press the tube member, thereby stopping transport of the fluid, and configured to be positioned at the squeezing position, thereby squeezing the tube member, thereby transporting the fluid, if the squeezing member rotates in one direction around the shaft center, and be positioned at the release position, thereby stopping transport of the fluid, if the squeezing member rotates in the other direction opposite to the one direction around the shaft center, and the fluid transport device includes a flow passage selector having operating members provided so as to be movable between a closing position for closing internal flow passages of the flow passage members, and an opening position for opening the internal flow passages of the flow passage members, and an eccentric cam configured to rotate, thereby moving the operating members between the closing position and the opening position, thereby opening and closing the internal flow passages of the flow passage members, and a one-way clutch provided between the squeezing member and the eccentric cam, and configured to regulate transmission of rotation of the squeezing member to the eccentric cam, thereby stopping the eccentric cam, thereby maintaining the positions of the operating members, if the squeezing member rotates in the one direction, and transmit rotation of the squeezing member to the eccentric cam, thereby rotating the eccentric cam, thereby changing the positions of the operating members, if the squeezing member rotates in the other direction.

This invention has the one-way clutch configured to rotate or stop the eccentric cam for making the operating members open or close the internal flow passages of the flow passage members, by rotation of the pump. If the pump rotates in the one direction, the fluid is transported, and if the pump rotates in the other direction, transport of the fluid is stopped. Therefore, one drive source rotates the pump in two directions of a normal direction and a reverse direction, whereby it is possible for the pump to transport the fluid, and rotate the eccentric cam, thereby making the operating members open or close the internal flow passages of the flow passage members. Therefore, it is possible to use one drive source to transport the fluid and open or close the internal flow passages of the flow passage members.

Also, since the flow passage selector has the eccentric cam configured to move the operating members between the closing position and the opening position, thereby opening or closing the internal flow passages of the flow passage members, it is possible to move the plurality of operating members between the closing position and the opening position by one eccentric cam, whereby it is possible to open or close the internal flow passages of the plurality of flow passage members. Therefore, it is possible to open and close the internal flow passages of the plurality of flow passage members by one drive source. Therefore, the fluid transport device of this invention can perform transport of the fluid and opening and closing of the internal flow passages of the plurality of flow passage members by one drive source. Therefore, it is possible to reduce the number of components, and it is possible to reduce the cost and the size.

Further, since the fluid transport device has the one-way clutch between the squeezing member of the pump and the eccentric cam, even though an interval between the squeezing member of the pump and the eccentric cam is minimized, it is possible to transmit rotation of the squeezing member to the eccentric cam. Therefore, the fluid transport device can suppress an increase in the size.

Also, in the above-described fluid transport device, a rotation center of the squeezing member and a rotation center of the eccentric cam can be disposed on the same line or in parallel, and a cam surface of the eccentric cam configured to come into contact with the operating members and move the operating members between the closing position and the opening position, thereby opening or closing the internal flow passages of the flow passage members, if the eccentric cam rotates, can be formed in parallel to the rotation center of the eccentric cam.

In this invention, since the rotation center of the pump and the rotation center of the eccentric cam are disposed on the same line or in parallel, it is possible to suppress an increase in the size in the axial direction. Also, since the cam surface of the eccentric cam is formed in parallel to the rotation center of the eccentric cam, it is possible to make the movement direction of the operating members and the rotation center perpendicular to each other. Therefore, it is possible to further suppress an increase in the size in the axial direction.

Also, in the above-described fluid transport device, the eccentric cam and the one-way clutch can be disposed on the same axis.

In this invention, since the eccentric cam and the one-way clutch are disposed on the same axis, it is possible to suppress an increase in the size in the axial direction.

Also, in the above-described fluid transport device, the one-way clutch can be accommodated in the eccentric cam, and be provided so as to be movable in parallel to the rotation center of the eccentric cam.

In this invention, since the one-way clutch is accommodated in the eccentric cam, it is possible to reduce the dimension in the axial direction. Also, since the one-way clutch is movable in parallel to the rotation center of the eccentric cam, it is possible to minimize the movement range of the one-way clutch, and it is possible to suppress an increase in the size.

Also, in the above-described fluid transport device, the one-way clutch can have axial-direction movement cam surfaces configured to be separated from a power transmission part of the eccentric cam, thereby regulating transmission of rotation of the squeezing member to the eccentric cam, thereby stopping the eccentric cam, thereby maintaining the positions of the operating members, if the squeezing member rotates in the one direction, and to be pressed from the squeezing member in such a direction that they approach the power transmission part, thereby being connected to the power transmission part, thereby transmitting rotation of the squeezing member to the eccentric cam, thereby rotating the eccentric cam, thereby changing the positions of the operating members, if the squeezing member rotates in the other direction.

In this invention, since the one-way clutch has the axial-direction movement cam surfaces which can be pressed from the squeezing member in such a direction that they approach the power transmission part of the eccentric cam, thereby being connected to the power transmission part, it is possible to connect the one-way clutch to the eccentric cam, without always biasing the power transmission part of the one-way clutch by springs and the like. Therefore, it is possible to suppress the one-way clutch from being rubbed against the power transmission part of the eccentric cam by biasing forces of springs and the like, thereby being worn away. Further, since the one-way clutch is not biased by a spring or the like, when the squeezing member transports the fluid, it is possible to suppress the spring or the like from becoming resistance to the operation of the squeezing member.

Also, the above-described fluid transport device can have biasing members for biasing the operating members against the cam surface, respectively, wherein recesses to be locked by the operating members having opened the internal flow passages of the flow passage members, and recesses to be locked by the operating members having closed the internal flow passages of the flow passage members can be formed at intervals in a circumferential direction of the cam surface.

In this invention, since the cam surface has the recesses to be locked by the operating members, when the squeezing member transports the fluid, it is possible to suppress the internal flow passages of the flow passage members from being abruptly switched between a closed state and an open state.

Advantageous Effects of Invention

The fluid transport device according to the present invention has an effect that it is possible to reduce the cost and the size.

DESCRIPTION OF EMBODIMENTS

Hereinafter, an embodiment according to the present invention will be described in detail with reference to drawings. However, the present invention is not limited to that embodiment. Also, components of the following embodiment include components which those skilled in the art can easily replace them with, or components substantially identical to them.

[Embodiment]

Figure 1:
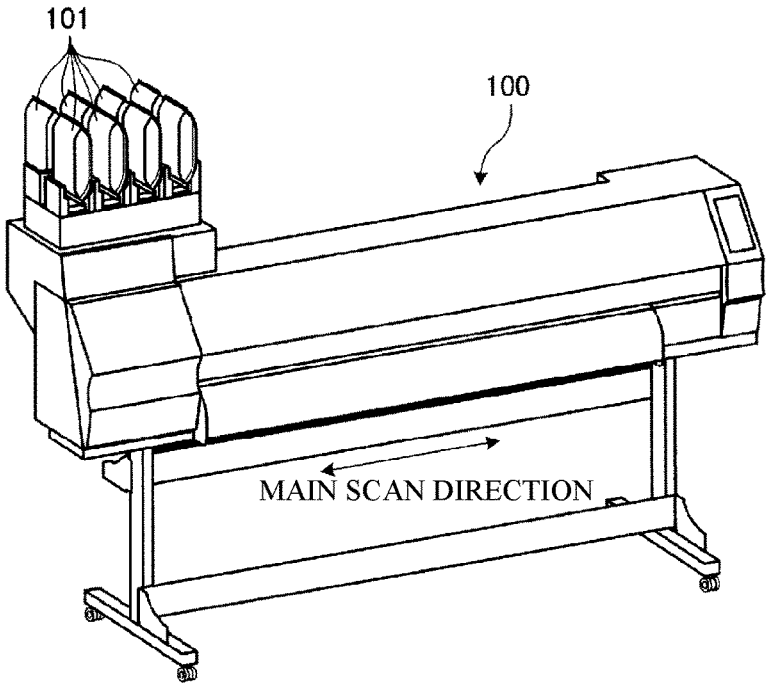
FIG. 1 is a perspective view illustrating an example of an inkjet printer having a waste ink recovery device according to an embodiment.
Figure 2:
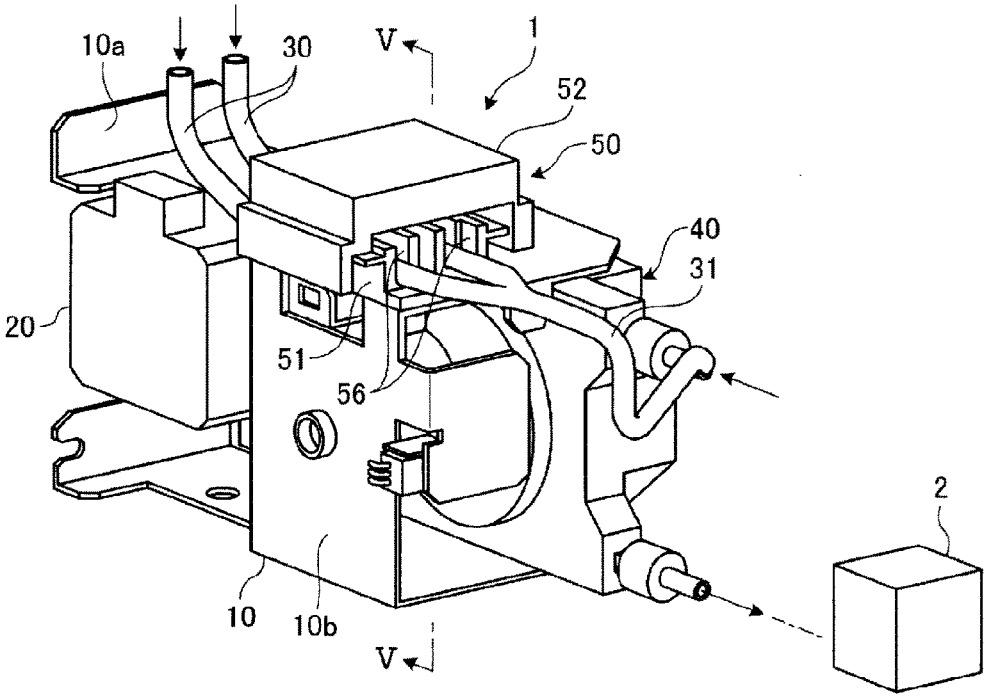
FIG. 2 is a perspective view illustrating a configuration example of the waste ink recovery device according to the embodiment.
Figures 3, 4:
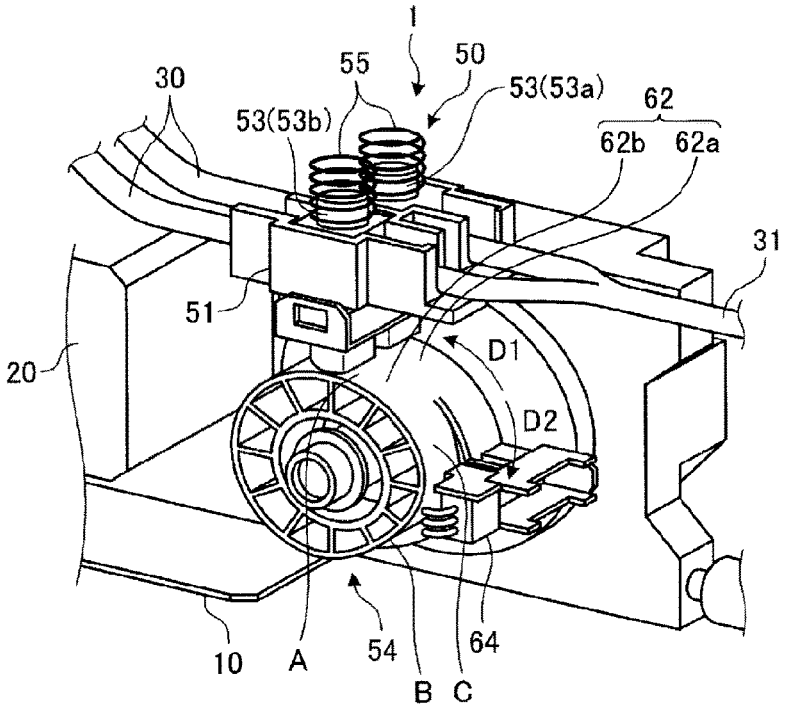
FIG. 3 is a perspective view illustrating a main part of the waste ink recovery device according to the embodiment.
FIG. 4 is a view illustrating individual positions of an eccentric cam of the waste ink recovery device according to the embodiment.

Hereinafter, as a fluid transport device according to an embodiment of the present invention, a waste ink recovery device will be described in detail with reference to drawings. FIG. 1 is a perspective view illustrating an example of an inkjet printer having a waste ink recovery device according to the embodiment. FIG. 2 is a perspective view illustrating a configuration example of the waste ink recovery device according to the embodiment. FIG. 3 is a perspective view illustrating a main part of the waste ink recovery device according to the embodiment. FIG. 4 is a view illustrating individual positions of an eccentric cam of the waste ink recovery device according to the embodiment.

A waste ink recovery device 1 (hereinafter, referred to simply as a recovery device) which is a fluid transport device according to the present embodiment is applied to an inkjet printer 100 shown in FIG. 1. The inkjet printer 100 is a printer configured to reciprocate a head having a plurality of nozzles for ejecting ink supplied from an ink container 101, in a main scan direction, and eject ink from the nozzles onto print media, thereby performing printing on the print media. The recovery device 1 is installed out of a range in which the head moves in the main scan direction during printing, and is a device configured to generate a negative pressure in caps (not shown in the drawings) sealing the nozzles, thereby discharging ink (hereinafter, referred to as waste ink) as thickened fluid contained in the nozzles, and transporting and recovering the waste ink into a recovery container 2 (shown in FIG. 2).

Figure 5:
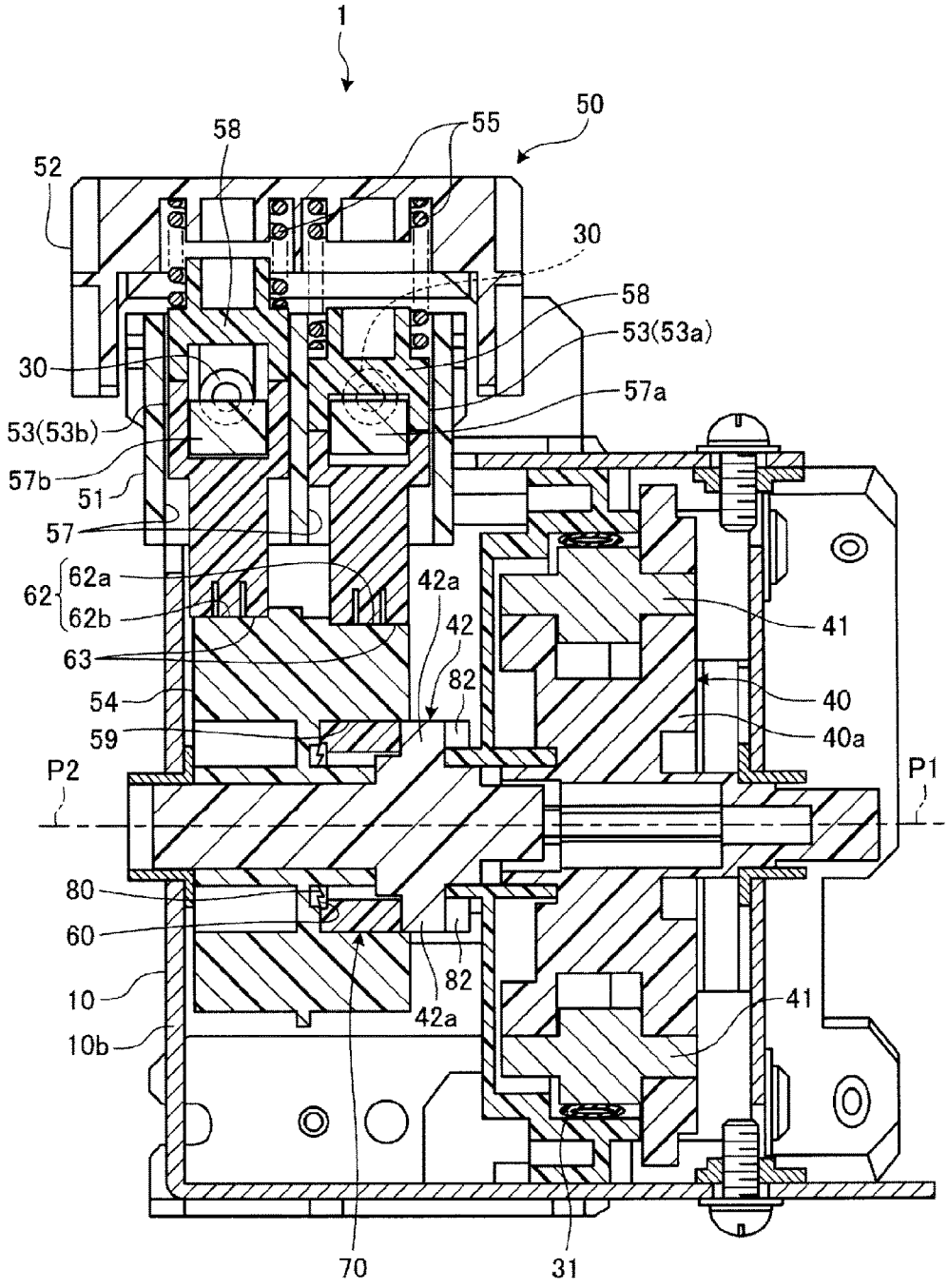
FIG. 5 is a cross-sectional view taken along a line V-V of FIG. 2.
Figure 6A:
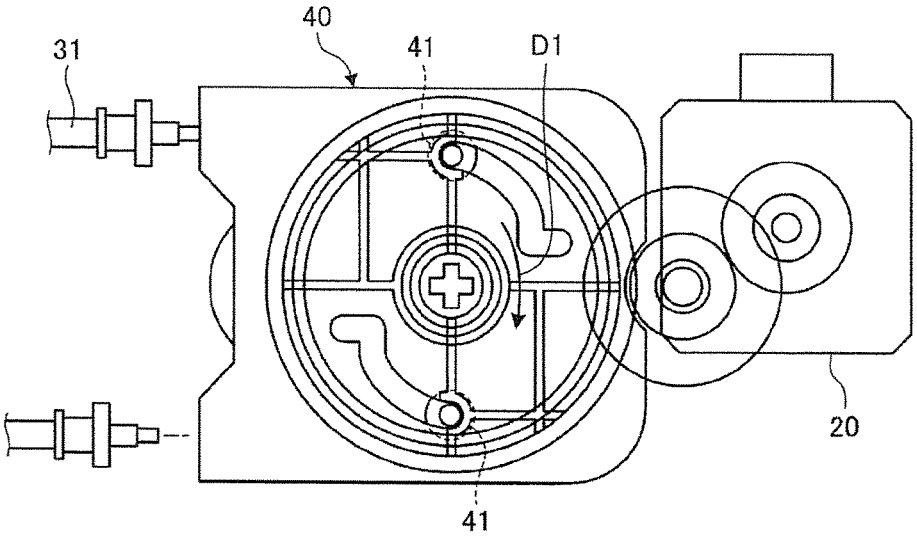
FIG. 6A and FIG. 6B are side views illustrating a pump, a motor, and the like of the recovery device according to the embodiment.
Figure 6B:
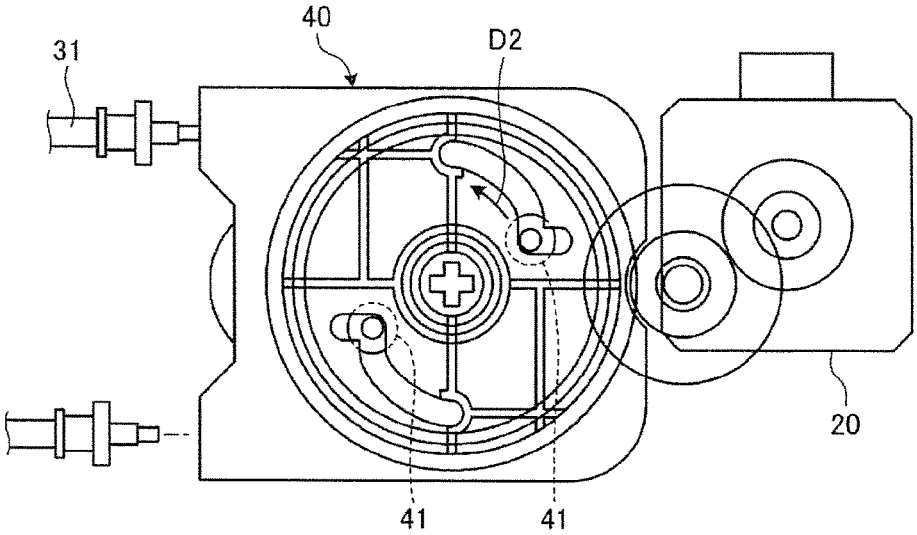
Figure 7:
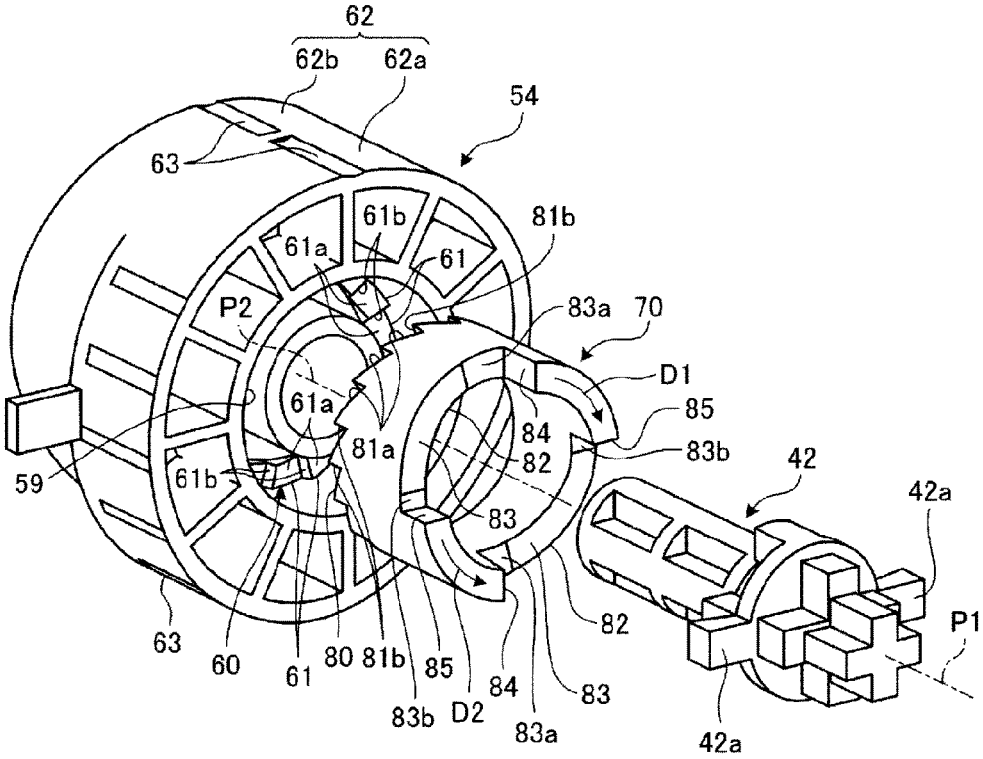
FIG. 7 is an exploded perspective view illustrating the eccentric cam, a one-way clutch, a shaft member, and the like of the recovery device according to the embodiment.
Figure 8:
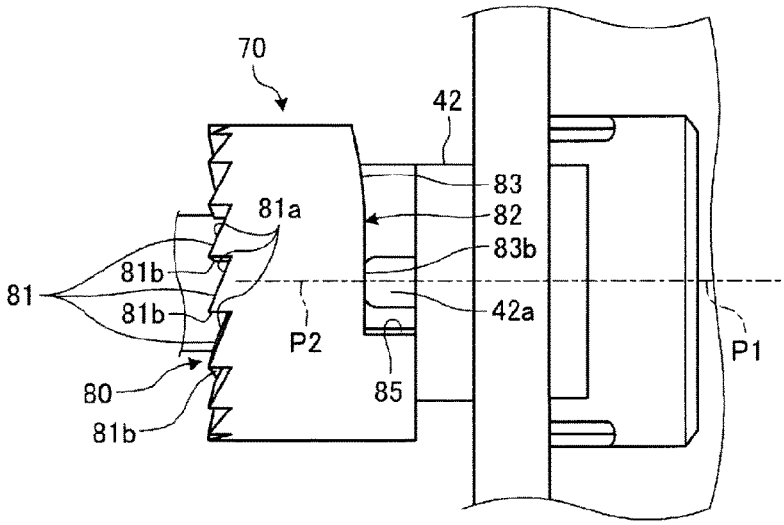
FIG. 8 is a side view illustrating a state where the one-way clutch, the shaft member, and the like shown in FIG. 7 have been assembled.

Now, the recovery device 1 will be described in detail with reference to drawings. FIG. 5 is a cross-sectional view taken along a line V-V of FIG. 2. FIG. 6A is a side view illustrating a pump, a motor, and the like when the recovery device 1 according to the embodiment transports waste ink, and FIG. 6B is a side view illustrating the pump, the motor, and the like when the recovery device 1 according to the embodiment stops transport of waste ink. FIG. 7 is an exploded perspective view illustrating an eccentric cam, a one-way clutch, a shaft member, and the like of the recovery device 1 according to the embodiment. FIG. 8 is a side view illustrating a state where the one-way clutch, the shaft member, and the like shown in FIG. 7 have been assembled.

As shown in FIG. 2, the recovery device 1 has a frame 10, one motor 20 (corresponding to a drive source), a plurality of flow passage members 30, a tubing pump 40 (corresponding to a pump), a flow passage selector 50, and a one-way clutch 70 (shown in FIG. 5 and so on).

The frame 10 is fixed to a frame (not shown in the drawings) of the inkjet printer 100. The motor 20 is fixed to one end portion 10*a* of the frame 10. The plurality of flow passage members 30 corresponds to the caps on a one-to-one basis, and guides waste ink contained in the nozzles into the recovery container 2 through the tubing pump 40. In the present embodiment, two flow passage members 30 are provided. However, the present invention is not limited thereto, and three or more flow passage members may be provided. One end of each of the flow passage members 30 are connected to a cap and the like described above. The other ends of the flow passage members 30 are connected to one tube member 31. The flow passage members 30 and the tube member 31 are for moving waste ink through the tubing pump 40. The one tube member 31 passes through the outer circumference of the tubing pump 40, and then is connected to the recovery container 2. In a state where the tube member 31 has passed through the outer circumference of the tubing pump 40, it is held by the frame 10 and so on. The flow passage members 30 and the tube member 31 are made of a resin having flexibility and elasticity, and are formed in a pipe shape. Since the flow passage members 30 and the tube member 31 are made of a resin having flexibility and elasticity, if they are crushed, their internal flow passages for allowing waste ink to pass are closed, and if they return to their original shapes, the internal flow passages are opened.

The tubing pump 40 is configured to rotate around a shaft center by a driving force of the motor 20, thereby transporting waste ink having entered the tube member 31 through the flow passage members 30, into the recovery container 2. The tubing pump 40 is provided on the other end portion 10*b* of the frame 10 so as to be rotatable around a rotation center P1 (shown in FIG. 5). The tubing pump 40 has a squeezing member 40*a* configured to rotate around the shaft center, and the tube member 31. The squeezing member 40*a* has a roller 41. Also, the squeezing member 40*a* of the tubing pump 40 rotates in two directions, that is, one direction D1 (shown by arrows in FIG. 3 and so on) for transporting waste ink contained in the tube member 31 into the recovery container 2, and the other direction D2 (shown by arrows in FIG. 3 and so on) which is the opposite direction to the one direction D1 and is for stopping transport of waste ink, by the driving force of the motor 20. The roller 41 is attached to the squeezing member 40*a* so as to be movable between a squeezing position (shown in FIG. 6A) to which the roller is moved in a state where the roller has been advanced so as to be able to press the tube member 31, thereby squeezing the tube member 31, thereby transporting waste ink into the recovery container 2, and a release position (shown in FIG. 6B) to which the roller is moved in a state where the roller has been retracted so as not to press the tube member 31 (so as to be separated from the tube member 31, or so as to be in contact with the tube member without pressing the tube member), thereby stopping transport of waste ink. If the squeezing member 40*a* rotates in the one direction D1, the roller 41 is positioned at the squeezing position, thereby squeezing the tube member 31, thereby transporting waste ink; whereas if the squeezing member 40*a* rotates in the other direction D2, the roller is positioned at the release position, thereby stopping transport of waste ink. If the squeezing member 40*a* rotates in the one direction D1, the roller 41 is advanced to the outer edge portion of the squeezing member 40*a* so as to be able to press the tube member 31, and rotates together with the squeezing member 40*a* in the one direction D1, thereby squeezing the tube member 31, thereby transporting waste ink. Also, if the squeezing member 40*a* rotates in the other direction D2, the roller 41 is retracted to the inner edge portion of the squeezing member 40*a* so as not to press the tube member 31, and rotates together with the squeezing member 40*a* in the other direction D2, thereby stopping transport of waste ink without squeezing the tube member 31. If the squeezing member 40*a* of the tubing pump 40 is rotated in the one direction D1 by the driving force of the motor 20, the roller 41 squeezes the tube member 31 (first closes the internal flow passage of the tube member 31 and then opens it), thereby transporting waste ink contained in the tube member 31 into the recovery container 2.

As shown in FIG. 5, the flow passage selector 50 has a tube holding member 51, a cap member 52, a plurality of operating members 53, an eccentric cam 54, and a plurality of biasing members 55.

The tube holding member 51 is attached to the other end 10*b* of the frame 10, and has grooves 56 formed so as to be able to hold the flow passage members 30. The grooves 56 are formed so as to correspond to the flow passage members 30 on a one-to-one basis, and accommodate the flow passage members 30, thereby holding the flow passage members 30. Also, the tube holding member 51 has slide holes 57 formed as shown in FIG. 5 to support the operating members 53 such that the operating members are slidable in the radial direction of the eccentric cam 54. The slide holes 57 are formed through the tube holding member 51, and correspond to the operating members 53 on a one-to-one basis. In the present embodiment, two grooves 56 and two slide holes 57 are formed. However, the present invention is not limited thereto, and three or more grooves and three or more slide holes may be formed. The cap member 52 is attached to the outer side of the tube holding member 51, and regulates dropping off of the flow passage members 30, the operating members 53, and the biasing members 55 from the tube holding member 51.

The operating members 53 are provided corresponding to the plurality of flow passage members 30 on a one-to-one basis, and are supported inside the slide holes 57 so as to be slidable in the radial direction of the eccentric cam 54, such that they are movable between a closing position (shown by a reference symbol 53*a* in FIG. 5) where they crush the flow passage members 30, thereby closing the internal flow passages of the flow passage members 30, and an opening position (shown by a reference symbol 53*b* in FIG. 5) where they open the internal flow passages of the flow passage members 30. In the present embodiment, two operating members 53 are provided. However, the present invention is not limited thereto, and three or more operating members may be provided. The operating members 53 have opening/closing parts 58 for crushing the flow passage members 30 between clamping parts 57*a* or 57*b* of the tube holding member 51 provided inside the slide holes 57, thereby closing the flow passages. If the operating members 53 move downward (to the closing position) inside the slide holes 57 as seen in FIG. 5, the opening/closing parts 58 of the operating members 53 crush the flow passage members 30 between the clamping parts 57*a* and between the clamping parts 57*b*, thereby closing the internal flow passages of the flow passage members 30. Thereafter, if the operating members 53 move upward (to the opening position) as seen in FIG. 5, the opening/closing parts 58 are separated from the clamping parts 57*a* and 57*b*, whereby the crushed flow passage members 30 return to their original shapes, whereby the internal flow passages of the flow passage members 30 are opened.

The biasing members 55 are provided corresponding to the operating members 53 on a one-to-one basis. In the present embodiment, two biasing members 55 are provided. However, the present invention is not limited thereto, and three or more biasing members may be provided according to the number of operating members 53. The biasing members 55 are composed of coil springs, and are provided between the cap member 52 and the operating members 53, and bias the operating members 53 toward a cam surface 62 formed at the outer periphery of the eccentric cam 54, respectively.

The eccentric cam 54 is formed in a ring shape, and is configured to rotate, thereby moving the operating members 53 between the closing position and the opening position, thereby making the operating members 53 open and close the internal flow passages of the flow passage members 30. The eccentric cam 54 is supported by the frame 10 so as to be rotatable around a rotation center P2 (shown in FIG. 5). Also, the eccentric cam 54 is fit on a shaft member 42 attached so as to have the same axis as the rotation center P1 of the squeezing member 40*a* of the tubing pump 40 as shown in FIG. 7, thereby being supported by a shaft member 42 so as to be able to rotate integrally with the shaft member 42. Also, as shown in FIG. 7, the shaft member 42 is formed in a columnar shape, and is formed integrally with slide parts 42*a* extending in the radial direction. In the present embodiment, two slide parts 42*a* are provided so as to extend in opposite directions from the shaft member 42. The shaft member 42 is disposed on the same axis as that of the squeezing member 40*a* of the tubing pump 40, and rotates together with the squeezing member 40*a* of the tubing pump 40.

Also, the rotation center P2 of the eccentric cam 54 is disposed on the same line as the rotation center P1 of the squeezing member 40*a* of the tubing pump 40. Also, as shown in FIG. 7, the eccentric cam 54 has a clutch accommodating chamber 59 formed therein to accommodate the one-way clutch 70. At the back of the clutch accommodating chamber 59, a power transmission part 60 is provided. The power transmission part 60 is formed in a ring shape having the same axis as the rotation center P2 of the eccentric cam 54. The power transmission part 60 has a plurality of transmission teeth 61 arranged in the circumferential direction. Each transmission tooth 61 has an inclined surface 61*a* formed such that the amount of protrusion toward the squeezing member 40*a* of the tubing pump 40 gradually decreases as it goes toward the other direction D2, and an end surface 61*b* formed toward the one direction D1 in parallel to the rotation center P2.

As shown in FIG. 3, the eccentric cam 54 has the cam surface 62 formed at the periphery so as to abut on the operating members 53 and move the operating members 53 between the closing position and the opening position, thereby making the operating members 53 open and close the internal flow passages of the flow passage members 30. The cam surface 62 of the eccentric cam 54 is composed of a curved surface formed in parallel to the rotation center P2 of the eccentric cam 54, and has a first cam surface 62*a* corresponding to one operating member 53 (hereinafter, represented by a reference symbol 53*a*), and a second cam surface 62*b* corresponding to the other operating member 53 (hereinafter, represented by a reference symbol 53*b*).

Each of the cam surfaces 62*a* and 62*b* is composed of a curved surface, and integrally has a large-diameter portion A which has a large external diameter and is for opening the internal flow passage of the operating member 53*a* or 53*b*, a small-diameter portion B which has an external diameter smaller than that of the large-diameter portion A and is for closing the internal flow passage of the operating member 53*a* or 53*b*, and a curved connection surface portion C (shown in FIG. 3) connecting them. In the present embodiment, as shown in FIG. 4, when a position where both of top portions of the cam surfaces 62*a* and 62*b* abutting on the operating members 53 become the large-diameter portions A is defined as the origin of the eccentric cam 54, at a position when the eccentric cam 54 has rotated in the one direction D1 from the origin by a first predetermined angle (for example, 135 degrees), the large-diameter portion A of the first cam surface 62*a* is provided, thereby making the operating member 53*a* open the internal flow passage of a corresponding flow passage member 30, and the small-diameter portion B of the second cam surface 62*b* is provided, thereby making the operating member 53*b* close the internal flow passage of a corresponding flow passage member 30. Also, at a position when the eccentric cam 54 has rotated in the one direction D1 from the origin by a second predetermined angle (for example, 225 degrees), the small-diameter portion B of the first cam surface 62*a* is provided, thereby making the operating member 53*a* close the internal flow passage of the corresponding flow passage member 30, and the large-diameter portion A of the second cam surface 62*b* is provided, thereby making the operating member 53*b* open the internal flow passage of the corresponding flow passage member 30.

Also, in the top portions of the cam surfaces 62*a* and 62*b* at the origin of the eccentric cam 54, the position when the eccentric cam has rotated in the one direction D1 from the origin by the first predetermined angle, and the position when the eccentric cam has rotated in the one direction D1 from the origin by the second predetermined angle, recesses 63 to be locked by the operating members 53 are formed as illustrated in FIG. 7. In the cam surfaces 62*a* and 62*b*, the recesses 63 extend in a linear shape parallel to the rotation center P2 of the eccentric cam 54. In this way, in the cam surfaces 62*a* and 62*b* of the cam surface 62, the recesses 63 to be locked by the operating members 53*a* and 53*b* having opened the internal flow passages of the flow passage members 30, and the recesses 63 to be locked by the operating members 53*a* and 53*b* having closed the internal flow passages of the flow passage members 30 are formed at intervals in the circumferential direction of the cam surface 62. In the present invention, two cam surfaces 62*a* and 62*b* are formed. However, the present invention is not limited thereto, and three or more cam surfaces may be provided according to the number of operating members 53. Also, the eccentric cam 54 shown in FIG. 3 and FIG. 7 is positioned at the origin, and FIG. 5 shows the eccentric cam 54 having rotated in the one direction D1 from the origin by the second predetermined angle.

Also, for the eccentric cam 54 or the like, a detection sensor 64 for detecting whether the position of the eccentric cam 54 is the origin is provided. The detection sensor 64 outputs the detection result, that is, whether the position of the eccentric cam 54 is the origin, to a control means (not shown in the drawings) for controlling operations of the motor 20 and so on. The control means is composed of hardware such as an arithmetic device and a memory, and a program configured to implement predetermined functions of them.

The one-way clutch 70 is formed in a cylindrical shape, and is fit on the shaft member 42 so as to be set between the squeezing member 40*a* of the tubing pump 40 and the eccentric cam 54 as shown in FIG. 5 and FIG. 8. The one-way clutch 70 is accommodated in the clutch accommodating chamber 59, and is disposed on the same axis as that of the eccentric cam 54, and is accommodated in the eccentric cam 54, and is fit on the shaft member 42 so as to be movable in parallel to the rotation center P2 of the eccentric cam 54. If the squeezing member 40*a* of the tubing pump 40 rotates in the one direction D1, the eccentric cam 54 regulates transmission of the rotation of the squeezing member 40*a* of the tubing pump 40 to the eccentric cam 54 through the shaft member 42, thereby stopping the eccentric cam 54, thereby maintaining the positions of the operating members 53*a* and 53*b* of the flow passage selector 50, and if the squeezing member 40*a* of the tubing pump 40 rotates in the other direction D2, the rotation of the squeezing member 40*a* of the tubing pump 40 is transmitted to the eccentric cam 54 through the shaft member 42, thereby rotating the eccentric cam 54, thereby changing the positions of the operating members 53*a* and 53*b* of the flow passage selector 50.

The one-way clutch 70 has a clutch side power transmission part 80 facing the power transmission part 60 of the eccentric cam 54, and axial-direction movement cam surfaces 82 facing the squeezing member 40*a* of the tubing pump 40. The clutch side power transmission part 80 is formed in a ring shape having the same axis as the rotation center P2 of the eccentric cam 54. The clutch side power transmission part 80 has a plurality of clutch side transmission teeth 81 arranged in the circumferential direction. Each clutch side transmission tooth 81 has an inclined surface 81*a* formed such that the amount of protrusion toward the eccentric cam 54 gradually decreases as it goes toward the one direction D1, and an end surface 81*b* formed toward the other direction D2 in parallel to the rotation center P2.

The clutch side power transmission part 80 is engaged with and connected to the power transmission part 60 of the eccentric cam 54 such that the inclined surfaces 81*a* overlap the inclined surfaces 61*a* of the power transmission part 60 and the end surfaces 81*b* overlap the end surfaces 61*b* of the power transmission part 60. If the clutch side power transmission part 80 is engaged with and connected to the power transmission part 60 of the eccentric cam 54, since the end surfaces 61*b* and 81*b* are parallel to the rotation center P2, the eccentric cam 54 is rotated together with the one-way clutch 70 in the other direction D2. Also, since the inclined surfaces 61*a* and 81*a* are inclined as described above even though the clutch side power transmission part 80 is engaged with the power transmission part 60 of the eccentric cam 54, if the one-way clutch rotates in the one direction D1, the clutch side power transmission part 80 moves the one-way clutch 70 toward the squeezing member 40*a* of the tubing pump 40 such that the engagement of the transmission teeth 61 and 81 is released.

If the squeezing member 40*a* of the tubing pump 40 rotates in the one direction D1, the axial-direction movement cam surfaces 82 separate the clutch side power transmission part 80 of the one-way clutch 70 from the power transmission part 60 of the eccentric cam 54, thereby regulating transmission of the rotation of the squeezing member 40*a* of the tubing pump 40 to the eccentric cam 54, thereby stopping the eccentric cam 54, thereby maintaining the positions of the operating members 53*a* and 53*b*. If the squeezing member 40*a* of the tubing pump 40 rotates in the other direction D2, the axial-direction movement cam surfaces 82 are pressed from the shaft member 42 attached to the squeezing member 40*a* of the tubing pump 40, in such a direction that the clutch side power transmission part 80 of the one-way clutch 70 approaches the power transmission part 60, whereby the transmission teeth 61 and 81 are engaged with each other, whereby the clutch side power transmission part 80 is connected to the power transmission part 60, whereby the rotation of the squeezing member 40*a* of the tubing pump 40 is transmitted to the eccentric cam 54, whereby the eccentric cam 54 is rotated, whereby the positions of the operating members 53*a* and 53*b* are changed. As shown in FIG. 7, the one-way clutch 70 has two axial-direction movement cam surfaces 82 formed in the circumferential direction.

As shown in FIG. 7 and FIG. 8, the axial-direction movement cam surfaces 82 have slide cam surfaces 83, transport time connection surfaces 84 (shown in FIG. 7), and switch time connection surfaces 85. Each slide cam surface 83 is inclined in such a direction that it gradually approaches the eccentric cam 54 as it goes toward the one direction D1 and gradually approaches the squeezing member 40*a* of the tubing pump 40 as it goes toward the other direction D2. On the slide cam surfaces 83, the slide parts 42*a* of the shaft member 42 can slide. Also, if the slide parts 42*a* are positioned on end portions 83*a* of the slide cam surfaces 83 positioned toward the one direction D1, the clutch side power transmission part 80 is separated from the power transmission part 60, whereby the engagement with the power transmission part 60 is released. If the slide parts 42*a* are positioned on the end portions 83*b* of the slide cam surfaces 83 positioned toward the other direction D2, the clutch side power transmission part 80 approaches the power transmission part 60, and is engaged with the power transmission part 60.

The connection surfaces 84 and 85 are formed in parallel to the rotation center P2. The transport time connection surfaces 84 are connected to ends of the slide cam surfaces 83 positioned toward the one direction D1, and when the squeezing member 40*a* of the tubing pump 40 rotates in the one direction D1, the transport time connection surfaces 84 abut on the slide parts 42*a* and are pressed from the slide parts 42*a*, whereby the one-way clutch 70 is rotated together with the squeezing member 40*a* of the tubing pump 40 in the one direction D1. The switch time connection surfaces 85 are connected to ends of the slide cam surfaces 83 positioned toward the other direction D2, and when the squeezing member 40*a* of the tubing pump 40 rotates in the other direction D2, the switch time connection surfaces abut on the slide parts 42*a* and are pressed from the slide parts 42*a*, whereby the one-way clutch 70 is rotated together with the squeezing member 40*a* of the tubing pump 40 in the other direction D2.

Figure 9:
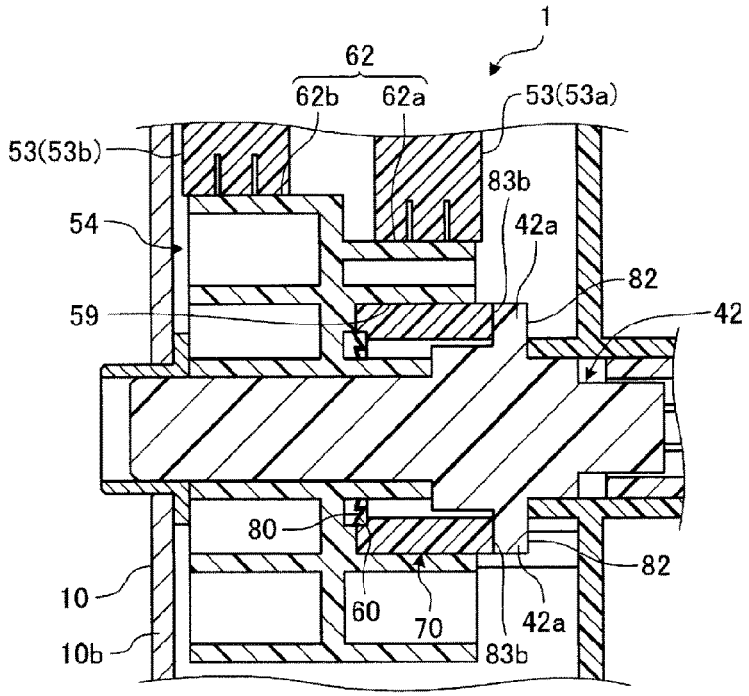
FIG. 9 is a side view of a state where a clutch side power transmission part of the one-way clutch of the waste ink recovery device according to the embodiment has been engaged with a power transmission part of the eccentric cam.
Figure 10:
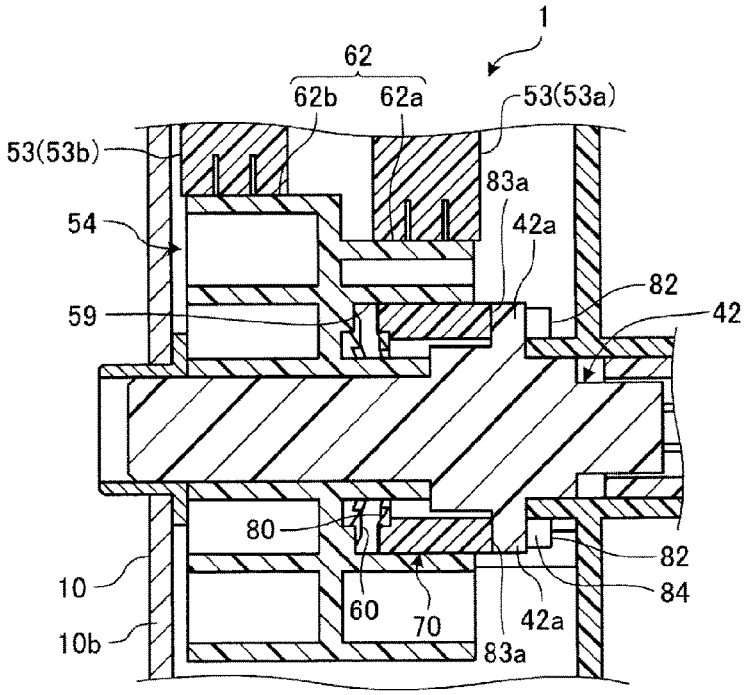
FIG. 10 is a cross-sectional view of a state where the clutch side power transmission part of the one-way clutch of the waste ink recovery device according to the embodiment has been separated from the power transmission part of the eccentric cam.
Figure 11:
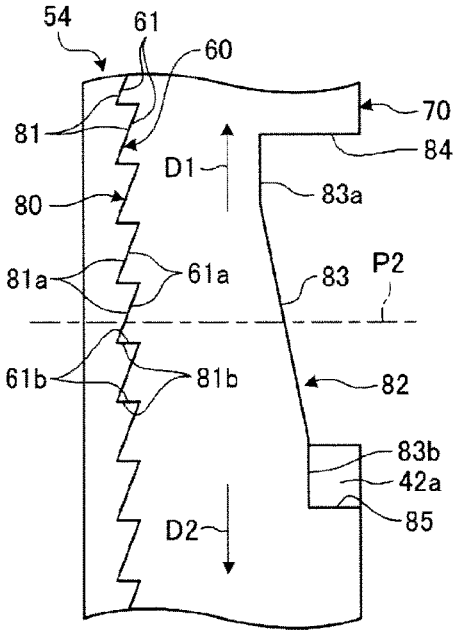
FIG. 11 is a development view illustrating an axial-direction movement cam surface and the like in the state where the clutch side power transmission part of the one-way clutch of the waste ink recovery device according to the embodiment has been engaged with the power transmission part of the eccentric cam, as seen from an outer circumferential direction.
Figure 12:
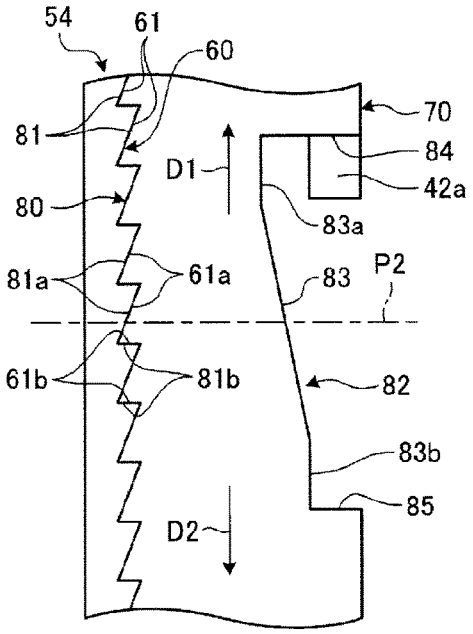
FIG. 12 is a development view illustrating a state where a tubing pump has been rotated in one direction from the state shown in FIG. 11, whereby slide parts have come into contact with transport time connection surfaces, as seen from the outer circumferential direction.
Figure 13:
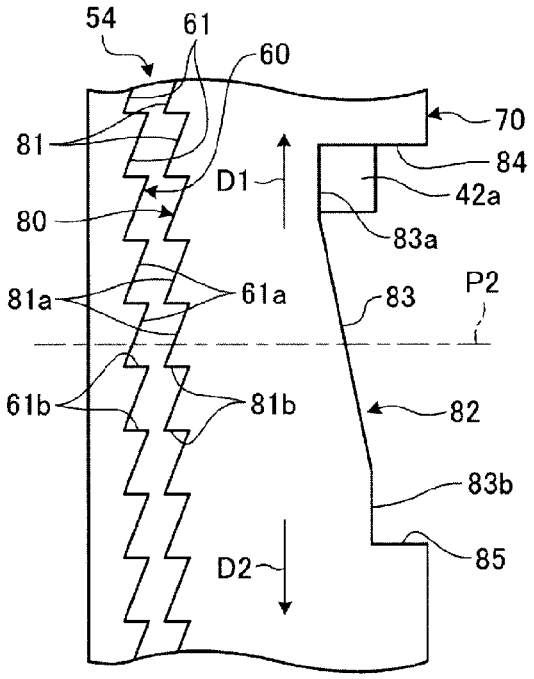
FIG. 13 is a development view illustrating a state where the tubing pump has been further rotated in the one direction from the state shown in FIG. 12, whereby the clutch side power transmission part of the one-way clutch has been separated from the power transmission part of the eccentric cam, as seen from the outer circumferential direction.
Figure 14:
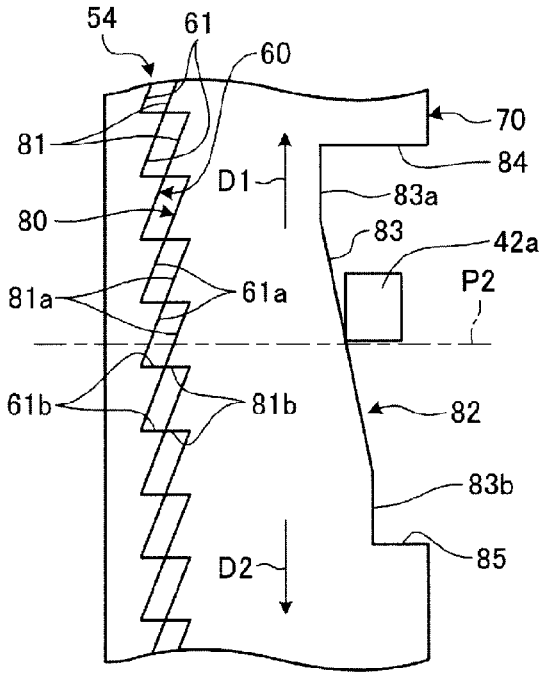
FIG. 14 is a development view illustrating a state where the tubing pump is rotated in the other direction from the state shown in FIG. 13, whereby the slide parts slide on slide cam surfaces, as seen from the outer circumferential direction.

Now, an operation of the one-way clutch 70 having the above-described configuration will be described on the basis of drawings. Also, FIG. 9 is a cross-sectional view of a state where the clutch side power transmission part 80 of the one-way clutch 70 of the waste ink recovery device 1 according to the embodiment has been engaged with the power transmission part 60 of the eccentric cam 54. FIG. 10 is a cross-sectional view of a state where the clutch side power transmission part 80 of the one-way clutch 70 of the waste ink recovery device 1 according to the embodiment has been separated from the power transmission part 60 of the eccentric cam 54. FIG. 11 is a development view of an axial-direction movement cam surface 82 and the like in the state where the clutch side power transmission part 80 of the one-way clutch 70 of the waste ink recovery device 1 according to the embodiment has been engaged with the power transmission part 60 of the eccentric cam 54, as seen from an outer circumferential direction. FIG. 12 is a development view illustrating a state where the tubing pump 40 has been rotated in the one direction D1 from the state shown in FIG. 11, whereby the slide parts 42*a* have come into contact with the transport time connection surfaces 84, as seen from the outer circumferential direction. FIG. 13 is a development view illustrating a state where the tubing pump 40 has been further rotated in the one direction D1 from the state shown in FIG. 12, whereby the clutch side power transmission part 80 of the one-way clutch 70 has been separated from the power transmission part 60 of the eccentric cam 54, as seen from the outer circumferential direction. FIG. 14 is a development view illustrating a state where the tubing pump 40 is rotated in the other direction D2 from the state shown in FIG. 13, whereby the slide parts 42*a* slide on the slide cam surfaces 83, as seen from the outer circumferential direction.

First, in the state where the clutch side power transmission part 80 of the one-way clutch 70 has been engaged with the power transmission part 60 of the eccentric cam 54, as shown in FIG. 9 and FIG. 11, the slide parts 42*a* of the shaft member 42 abut on the switch time connection surfaces 85, and are positioned on the end portions 83*b* of the slide cam surfaces 83 positioned toward the other direction D2. Then, if the squeezing member 40*a* of the tubing pump 40 rotates in the other direction D2, the shaft member 42 presses the switch time connection surfaces 85 toward the other direction D2, whereby the squeezing member 40*a* of the tubing pump 40 and the eccentric cam 54 integrally rotate in the other direction D2 with the one-way clutch 70 interposed therebetween.

In this way, the position of the eccentric cam 54 is switched, and the positions of the operating members 53*a* and 53*b* are changed, whereby the internal flow passages of the flow passage members 30 are opened or closed by the operating members 53*a* and 53*b*. Also, when the position of the eccentric cam 54 is switched, the control means rotates the eccentric cam 54 in the other direction D2 until the detection sensor 64 detects that the position of the eccentric cam 54 is the origin, and then rotates the eccentric cam 54 in the other direction D2 from the origin by the first predetermined angle or the second predetermined angle, thereby making the operating members 53*a* and 53*b* open or close the internal flow passages of the flow passage members 30, and locks the recesses 63 by the operating members 53*a* and 53*b*.

Also, if the squeezing member 40*a* of the tubing pump 40 is rotated in the one direction D1 from the state where the clutch side power transmission part 80 of the one-way clutch 70 has been engaged with the power transmission part 60 of the eccentric cam 54, the slide parts 42*a* of the shaft member 42 are separated from the switch time connection surfaces 85, and then come into contact with the transport time connection surfaces 84 as shown in FIG. 12. Then, if the squeezing member 40*a* of the tubing pump 40 further rotates in the one direction D1, the shaft member 42 presses the transport time connection surfaces 84 in the one direction D1, whereby the squeezing member 40*a* of the tubing pump 40 and the one-way clutch 70 integrally rotate in the one direction D1. Then, since the inclined surfaces 61*a* and 81*a* are inclined as described above, the inclined surfaces 81*a* of the clutch side power transmission part 80 are pressed in such a direction that they are separated from the inclined surfaces 61*a* of the power transmission part 60 of the eccentric cam 54, whereby the one-way clutch 70 moves toward the squeezing member 40*a* of the tubing pump 40 and is separated from the eccentric cam 54.

Then, the slide parts 42*a* are positioned on the end portions 83*a* of the slide cam surfaces 83 positioned toward the one direction D1, and the engagement of the clutch side power transmission part 80 of the one-way clutch 70 with the power transmission part 60 of the eccentric cam 54 is released as shown in FIGS. 10 and 13. In the state where the engagement of the clutch side power transmission part 80 of the one-way clutch 70 with the power transmission part 60 of the eccentric cam 54 has been released, even though the squeezing member 40*a* of the tubing pump 40 rotates in the one direction D1, since transmission of the rotation of the squeezing member 40*a* of the tubing pump 40 to the eccentric cam 54 is regulated, and the operating members 53*a* and 53*b* having locked the recesses 63 of the eccentric cam 54 are biased toward the cam surfaces 62*a* and 62*b* by the biasing members 55, the position of the eccentric cam 54 is maintained. Further, since the position of the eccentric cam 54 is maintained, the positions of the operating members 53*a* and 53*b* are maintained.

Also, if the squeezing member 40*a* of the tubing pump 40 rotates in the other direction D2 from the state where the engagement of the clutch side power transmission part 80 of the one-way clutch 70 with the power transmission part 60 of the eccentric cam 54 has been released, the slide parts 42*a* of the shaft member 42 slide on the slide cam surfaces 83, thereby moving toward the end portions 83*b* positioned toward the other direction D2. Then, since the slide cam surfaces 83 are inclined in the above-described direction, as shown in FIG. 14, the slide parts 42*a* press the slide cam surfaces 83 in such a direction that the clutch side power transmission part 80 of the one-way clutch 70 approaches the power transmission part 60 of the eccentric cam 54. Thereafter, if the slide parts 42*a* are positioned on the end portions 83*b* of the slide cam surfaces 83 positioned toward the other direction D2 and abut on the switch time connection surfaces 85, as shown in FIG. 9 and FIG. 11, the transmission teeth 61 and 81 of the power transmission parts 60 and 80 are engaged with each other, whereby rotation of the squeezing member 40*a* of the tubing pump 40 is transmitted to the eccentric cam 54.

The above-described recovery device 1 according to the embodiment has the one-way clutch 70 for rotating or stopping the eccentric cam 54 for making the operating members 53*a* and 53*b* open or close the internal flow passages of the flow passage members 30, by rotation of the squeezing member 40*a* of the tubing pump 40. Therefore, one motor 20 rotates the squeezing member 40*a* of the tubing pump 40 in two directions of a normal direction and a reverse direction, whereby it is possible for the squeezing member 40*a* of the tubing pump 40 to transport waste ink into the recovery container 2, and rotate the eccentric cam 54, thereby making the operating members 53*a* and 53*b* open or close the internal flow passages of the flow passage members 30. Therefore, the recovery device 1 can use one motor 20 to transport waste ink and open or close the internal flow passages of the flow passage members 30.

Also, since the flow passage selector 50 has the eccentric cam 54, and the eccentric cam 54 is rotated, thereby making the operating members 53*a* and 53*b* open or close the internal flow passages of the flow passage members 30, the recovery device 1 can make the plurality of operating members 53*a* and 53*b* open or close the internal flow passages of the flow passage members 30 by one eccentric cam 54. Therefore, it is possible to open or close the internal flow passages of the plurality of flow passage members 30 by one motor 20. Therefore, the recovery device 1 can perform transport of waste ink and opening and closing of the internal flow passages of the plurality of flow passage members 30 by one motor 20. Therefore, it is possible to reduce the number of components, and it is possible to reduce the cost and the size.

Further, since the recovery device 1 has the one-way clutch 70 between the squeezing member 40*a* of the tubing pump 40 and the eccentric cam 54, even though an interval between the squeezing member 40*a* of the tubing pump 40 and the eccentric cam 54 is minimized, it is possible to transmit rotation of the squeezing member 40*a* of the tubing pump 40 to the eccentric cam 54. Therefore, the recovery device 1 can suppress an increase in the size in the axial direction.

Since the rotation center P1 of the squeezing member 40*a* of the tubing pump 40 and the rotation center P2 of the eccentric cam 54 are disposed on the same line, the recovery device 1 can suppress an increase in the size in the axial direction. Also, since the cam surface 62 of the eccentric cam 54 is formed in parallel to the rotation center P2 of the eccentric cam 54, it is possible to make the movement direction of the operating members 53*a* and 53*b* perpendicular to the rotation centers P1 and P2. Therefore, it is possible to further suppress an increase in the size in the axial direction. Also, since the eccentric cam 54 and the one-way clutch 70 are disposed on the same axis, the recovery device 1 can suppress an increase in the size in the axial direction.

Further, since the one-way clutch 70 is accommodated in the eccentric cam 54, the recovery device 1 can reduce the dimension in the axial direction. Also, since the one-way clutch 70 is movable in parallel to the rotation center P2 of the eccentric cam 54, it is possible to minimize the movement range of the one-way clutch 70, and it is possible to suppress an increase in the size.

Since the one-way clutch 70 has the axial-direction movement cam surfaces 82 which can be pressed from the squeezing member 40*a* of the tubing pump 40 in such a direction that they approach the power transmission part 60 of the eccentric cam 54, the recovery device 1 can connect the one-way clutch 70 to the eccentric cam 54, without always biasing the one-way clutch 70 by a spring or the like. Therefore, it is possible to suppress the one-way clutch 70 from being rubbed against the power transmission part 60 of the eccentric cam 54 by a biasing force of a spring or the like, thereby being worn away. Further, since the one-way clutch 70 is not biased by a spring or the like, when the squeezing member 40*a* of the tubing pump 40 transports waste ink into the recovery container 2, it is possible to suppress a spring or the like from becoming resistance to the operation of the squeezing member 40*a* of the tubing pump 40.

In the recovery device 1, since the cam surface 62 has the recesses 63 to be locked by the operating members 53*a* and 53*b*, when the squeezing member 40*a* of the tubing pump 40 transports waste ink into the recovery container 2, even through the eccentric cam 54 and the one-way clutch 70 are separated, it is possible to suppress the insides of the flow passage members 30 from being abruptly switched between a closed state and an open state.

[Modification]

Figure 15:
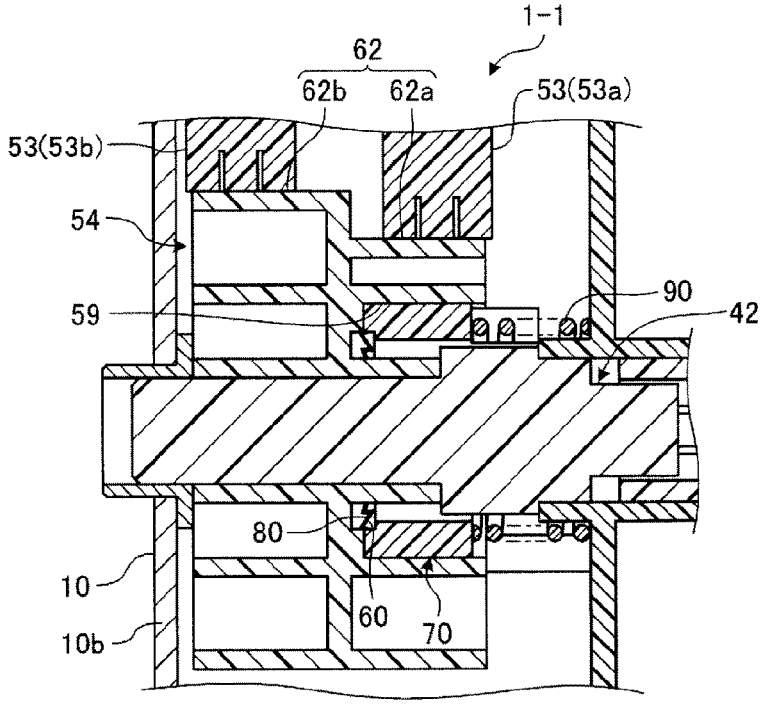
FIG. 15 is a cross-sectional view of the state where a clutch side power transmission part of a one-way clutch of a waste ink recovery device according to a modification of the embodiment has been engaged with the power transmission part of the eccentric cam.

Now, a recovery device 1-1 according to a modification of the above-described embodiment will be described. FIG. 15 is a cross-sectional view of a state where a clutch side power transmission part of a one-way clutch of the waste ink recovery device according to the modification of the embodiment has been engaged with a power transmission part of an eccentric cam. Also, in FIG. 15, parts identical to those of the embodiment are denoted by the same reference signs, and a description thereof is omitted.

As shown in FIG. 15, the recovery device 1-1 according to the modification has a biasing spring 90 for biasing the one-way clutch 70 in such a direction that the clutch side power transmission part 80 approaches the power transmission part 60, without providing the slide parts 42*a* and the axial-direction movement cam surfaces 82. Also, the one-way clutch 70 is provided so as to rotate integrally with the shaft member 42, that is, the squeezing member 40*a* of the tubing pump 40 and be movable along the rotation center P2.

In the modification, if the squeezing member 40*a* of the tubing pump 40 rotates in the one direction D1, since the inclined surfaces 61*a* and 81*a* are inclined as described above, the one-way clutch 70 moves along the rotation center P2 such that engagement of the power transmission parts 60 and 80 is released. Also, since the one-way clutch 70 is biased by the biasing spring 90, when the one-way clutch rotates together with the squeezing member 40*a* of the tubing pump 40 in the one direction D1, the one-way clutch reciprocates in parallel to the rotation center P2, whereby the clutch side transmission teeth 81 of the clutch side power transmission part 80 slide on the transmission teeth 61 of the power transmission part 60. In this way, if the squeezing member 40*a* of the tubing pump 40 is rotated in the one direction D1, the one-way clutch 70 regulates transmission of the rotation of the squeezing member 40*a* of the tubing pump 40 to the eccentric cam 54, thereby maintaining the position of the eccentric cam 54.

Also, in the modification, even though the squeezing member 40*a* of the tubing pump 40 rotates in the other direction D2, since the end surfaces 61*b* and 81*b* are parallel to the rotation center P2 as described above, engagement of the power transmission parts 60 and 80 is not released. In this way, the one-way clutch 70 allows rotation of the squeezing member 40*a* of the tubing pump 40 to be transmitted to the eccentric cam 54, thereby rotating the eccentric cam 54 together with the squeezing member 40*a* of the tubing pump 40.

Similarly to the embodiment, the recovery device 1-1 according to the modification has the one-way clutch 70 for rotating or stopping the eccentric cam 54 for making the operating members 53*a* and 53*b* open or close the internal flow passages of the flow passage members 30, by rotation of the squeezing member 40*a* of the tubing pump 40. Therefore, similarly to the embodiment, the recovery device 1-1 according to the modification can reduce the number of components, and can reduce the cost and the size.

Although the embodiment and the modification of the present invention have been described above, the present invention is not limited to them. In the present invention, it is possible to implement the embodiment and the modification in various other forms, and it is possible to make various changes such as omissions, substitutions, and combinations without departing from the gist of the invention. In the present invention, for example, it is possible to detect the position of the cam surface 62 of the eccentric cam 54 and open or close an electromagnetic valve or the like, thereby moving the operating members 53*a* and 53*b* between the closing position and the opening position. Also, in the embodiment and the modification, the waste ink recovery devices for transporting waste ink as a fluid have been described. However, the present invention may be applied to a fluid transport device for transporting ink as a fluid from an ink container 101 into a head or the like, and may be applied to a fluid transport device for transporting a cleaning solution as a fluid for cleaning nozzles of a head. In short, the present invention is not limited to application to the inkjet printer 100, and can be applied to fluid transport devices for transporting various fluids.

The invention claimed is:

1. A fluid transport device having one drive source, a pump configured to rotate around a shaft center by a driving force of the drive source, thereby transporting a fluid, and a plurality of flow passage members for transporting the fluid through the pump, wherein:

the pump includes a squeezing member configured to rotate around the shaft center, and a tube member constituting parts of the plurality of flow passage members, the squeezing member includes a roller attached thereto so as to be movable between a squeezing position to which the roller is moved in a state where the roller has been advanced so as to be able to press the tube member, thereby squeezing the tube member, thereby transporting the fluid, and a release position to which the roller is moved in a state where the roller has been retracted so as not to press the tube member, thereby stopping transport of the fluid, and configured to be positioned at the squeezing position, thereby squeezing the tube member, thereby transporting the fluid, if the squeezing member rotates in one direction around the shaft center, and be positioned at the release position, thereby stopping transport of the fluid, if the squeezing member rotates in the other direction opposite to the one direction around the shaft center, and the fluid transport device includes a flow passage selector having operating members provided so as to be movable between a closing position for closing internal flow passages of the flow passage members, and an opening position for opening the internal flow passages of the flow passage members, and an eccentric cam configured to rotate, thereby moving the operating members between the closing position and the opening position, thereby opening and closing the internal flow passages of the flow passage members, and a one-way clutch provided between the squeezing member and the eccentric cam, and configured to regulate transmission of rotation of the squeezing member to the eccentric cam, thereby stopping the eccentric cam, thereby maintaining the positions of the operating members, if the squeezing member rotates in the one direction, and transmit rotation of the squeezing member to the eccentric cam, thereby rotating the eccentric cam, thereby changing the positions of the operating members, if the squeezing member rotates in the other direction.

2. The fluid transport device according to claim 1, wherein:

a rotation center of the squeezing member and a rotation center of the eccentric cam are disposed on the same line or in parallel, and a cam surface of the eccentric cam configured to come into contact with the operating members and move the operating members between the closing position and the opening position, thereby opening or closing the internal flow passages of the flow passage members, if the eccentric cam rotates, is formed in parallel to the rotation center of the eccentric cam.

3. The fluid transport device according to claim 2, wherein:

the eccentric cam and the one-way clutch are disposed on the same axis.

4. The fluid transport device according to claim 3, wherein:

the one-way clutch is accommodated in the eccentric cam, and is provided so as to be movable in parallel to the rotation center of the eccentric cam.

5. The fluid transport device according to claim 4, wherein:

the one-way clutch has axial-direction movement cam surfaces configured to be separated from a power transmission part of the eccentric cam, thereby regulating transmission of rotation of the squeezing member to the eccentric cam, thereby stopping the eccentric cam, thereby maintaining the positions of the operating members, if the squeezing member rotates in the one direction, and to be pressed from the squeezing member in such a direction that they approach the power transmission part, thereby being connected to the power transmission part, thereby transmitting rotation of the squeezing member to the eccentric cam, thereby rotating the eccentric cam, thereby changing the positions of the operating members, if the squeezing member rotates in the other direction.

6. The fluid transport device according to claim 5, further comprising:

biasing members for biasing the operating members against the cam surface, respectively, wherein recesses to be locked by the operating members having opened the internal flow passages of the flow passage members, and recesses to be locked by the operating members having closed the internal flow passages of the flow passage members are formed at intervals in a circumferential direction of the cam surface.

* * * * *